US008340718B2

(12) United States Patent
Colonna et al.

(10) Patent No.: US 8,340,718 B2
(45) Date of Patent: Dec. 25, 2012

(54) METHOD AND SYSTEM FOR ESTIMATING ROAD TRAFFIC

(75) Inventors: Massimo Colonna, Turin (IT); Piero Lovisolo, Turin (IT); Dario Parata, Turin (IT)

(73) Assignee: Telecom Italia S.p.A., Milan (IT)

( * ) Notice: Subject to any disclaimer, the term of this patent is extended or adjusted under 35 U.S.C. 154(b) by 257 days.

(21) Appl. No.: 12/809,008

(22) PCT Filed: Dec. 20, 2007

(86) PCT No.: PCT/EP2007/064340

§ 371 (c)(1),
(2), (4) Date: Jun. 17, 2010

(87) PCT Pub. No.: WO2009/080105

PCT Pub. Date: Jul. 2, 2009

(65) Prior Publication Data

US 2010/0273491 A1 Oct. 28, 2010

(51) Int. Cl.

| | |
|---|---|
| ***G06F 19/00*** | (2011.01) |
| ***G06G 7/70*** | (2006.01) |
| ***G06G 7/76*** | (2006.01) |
| ***G08G 1/00*** | (2006.01) |
| ***H04M 1/00*** | (2006.01) |
| ***H05K 11/00*** | (2006.01) |

(52) U.S. Cl. ..... 455/556.1; 701/117; 701/118; 701/119; 455/344

(58) Field of Classification Search ..... 455/556.1, 455/569.2, 575.9, 344, 345; 340/933, 934, 340/909, 992, 993; 701/117–119
See application file for complete search history.

(56) References Cited

U.S. PATENT DOCUMENTS

| | | | | |
|---|---|---|---|---|
| 5,173,691 | A | 12/1992 | Sumner | |
| 5,657,487 | A | 8/1997 | Doner | |
| 6,587,781 | B2 * | 7/2003 | Feldman et al. | 701/117 |
| 7,908,076 | B2 * | 3/2011 | Downs et al. | 701/117 |
| 8,150,610 | B2 * | 4/2012 | Filizola et al. | 701/118 |
| 2005/0227696 | A1 | 10/2005 | Kaplan | |
| 2007/0208494 | A1 | 9/2007 | Chapman et al. | |
| 2012/0150425 | A1 * | 6/2012 | Chapman et al. | 701/119 |

FOREIGN PATENT DOCUMENTS

| | | | |
|---|---|---|---|
| EP | 0763807 | A1 | 3/1997 |
| WO | 99/44183 | A1 | 9/1999 |
| WO | 03/041031 | A1 | 5/2003 |
| WO | 2007/077472 | A1 | 7/2007 |

OTHER PUBLICATIONS

International Search Report and Written Opinion dtd Sep. 10, 2008, PCT/EP2007/064340.

* cited by examiner

*Primary Examiner* — Wesley Kim
(74) *Attorney, Agent, or Firm* — Banner & Witcoff, Ltd.

(57) ABSTRACT

A method of estimating road traffic on a roads network, comprising: receiving information from at least one information source, wherein the information received from the at least one information source is one among a first information type and a second information type; defining at least two different information processing methods, each one associated with a respective one of said information type; selecting the information processing method based on the available information type and on predefined criteria; and processing with the selected information processing method the corresponding available information type; and providing an estimation of the road traffic based on the result of said processing.

22 Claims, 8 Drawing Sheets

| | Information type 1) | Information type 2) | Combined information types 1) and 2) |
|---|---|---|---|
| Information type 3) | **a1** | **b1** | **c1** |
| Information type 4) | **a2** | **b2** | **c2** |
| Information type 5) | **a3** | **b3** | **c3** |
| Information type 6) | **a4** | **b4** | **c4** |
| Information type 7) | **a5** | | **c5** |
| Information type 8) | **a6** | | **c6** |

$310_{12}$ $310_{13}$ $310_{14}$

| | Information type 1) | Information type 2) | Combined information types 1) and 2) |
|---|---|---|---|
| Information type 3) | **a1** | **b1** | **c1** |
| Information type 4) | **a2** | **b2** | **c2** |
| Information type 5) | **a3** | **b3** | **c3** |
| Information type 6) | **a4** | **b4** | **c4** |
| Information type 7) | **a5** | | **c5** |
| Information type 8) | **a6** | | **c6** |

$310_{21}$ $310_{31}$ $310_{41}$ $310_{51}$ $310_{61}$ $310_{71}$ $310_{53}$ 305

METHOD AND SYSTEM FOR ESTIMATING ROAD TRAFFIC

CROSS REFERENCE TO RELATED APPLICATIONS

This is a U.S. National Phase Application under 35 U.S.C. §371 of International Application No. PCT/EP2007/064340 filed Dec. 20, 2007, which was published Under PCT Article 21(2), the entire contents of which are incorporated herein by reference.

BACKGROUND OF THE INVENTION

1. Field of the Invention

The present invention generally relates to methods and systems for estimating, monitoring and managing road traffic. More specifically, the present invention proposes a highly flexible method and system for monitoring and/or estimating and/or managing the road traffic.

2. Description of the Related Art

The estimation, monitoring and management of road traffic are normally accomplished based on a count of the number of vehicles that pass through one or more points of the monitored network of roads.

The vehicles counting methods are essentially of two types: manual counting methods and automatic counting methods.

Manual vehicles counting methods provide that operators, staying at the prescribed monitoring points along the roads, visually count the passing vehicles.

Automatic vehicles counting methods provide for placing, on or within the road floor, detectors adapted to detect the passage of the vehicles. Different types of detectors can be used, the more common being:

- rubber pipes closed at an end and connected to a membrane at the other end; the passage of a vehicle over the pipe creates a pressure therein that causes the membrane to flex, determining the increase of a vehicles counter;
- metal coils through which an electric current is made to flow that produces an electromagnetic field; the passage of a vehicle alters the electromagnetic field, and this event is detected causing the increase of a vehicles counter;
- television cameras connected to automatic image recognition systems adapted to count the number of transiting vehicles.

The manual counting, requiring the continuous presence of people at the road sections to be monitored, is used only for time-limited monitoring campaigns.

On the contrary, automatic vehicles counting methods are used for monitoring the road traffic for relatively long periods of time; however, the deployment of the detectors on the roads network and their connection to a central data processing server is very expensive, especially in medium and large urban areas, which are the scenarios where the road traffic monitoring, estimation and management is more useful.

A known alternative to the above-described vehicles counting methods makes use of a certain number of vehicles (called "floating cars") equipped with a GPS receiver which regularly transmit to a service center its position and speed, thereby allowing the service center to estimate the road traffic.

This method is as well very expensive, and its effectiveness is closely related to the number of circulating vehicles equipped with GPS receiver, i.e. to the number of floating cars; due to this, continuous monitoring of all the main roads of a certain area may not be possible.

In recent years, cellular mobile telephony networks (cellular PLMNs—Public Land Mobile Networks) have also been used for the purposes of estimation, monitoring and management of the road traffic, thanks to the widespread presence of mobile phones among the population.

Systems that exploit cellular PLMNs for the estimation, monitoring and management of the road traffic can be classified according to the type of information on the position of the vehicles that they require for their operation.

In particular, a first class of systems requires a continuous and exact knowledge of the geographical position of the circulating vehicles. A system that requires this type of information is for instance described in WO 99/44183 A1. This document discloses a method for collecting information about traffic situations, i.e. about the current traffic situation and the optimum routes between any start position and any target, and for the purpose of utilizing a mobile phone network in a more efficient and expedient manner, suggests a method characterized by using information about motion and position of mobile phones or mobile communication equipment as input in the calculations thereof.

A second class of systems require the knowledge of the geographical positions in which handovers from cell to cell occur; the information about the handovers positions is obtained by means of known location techniques such as for instance UL-TOA (UpLink Time Of Arrival), E-OTD (Enhanced Observed Time Difference), CGI+TA (Cell Global Identity+Timing Advance), E-CGI+TA (Enhanced Cell Global Identity+Timing Advance). A system that requires this type of information is for example described in U.S. Pat. No. 5,657,487. This document describes a system for determining the location of a mobile station based upon measurable mobile data values such as those provided by mobile-assisted handoff (MAHO) procedures. The mobile stations make signal strength measurements of nearby base stations and return that information to the serving base station. A timing advance necessary to synchronize the mobile may also be determined. The signal strength measurements and the timing advance data then provide information to map to an estimated vehicle location. Since the mobiles are assumed to measure signal strength discretely, there may be several consecutive positions along a road which return identical mobile data. The road is thus segmented into constant segments which are consecutively indexed, and an association is established between the associated mobile data vector and the index. The process for location of a mobile consists of first finding the road for the mobile unit, then finding the position along the road. The mobile vector is sequentially input into a look up table or neural networks (one for each road in the sector) until an output coordinate pair actually lies near the corresponding road. From that point on, the input vector provides an index to a constant region along the road, so the mobile is unambiguously located as to which road, and to which segment along the road it occupies.

A third class of systems requires the knowledge of the identifiers of the cells among which the handovers occur. A system that requires this type of information is for instance described in US 2005/0227696 A1. This document describes a system and method that continuously extracts traffic load and speed on roads within the coverage area of a cellular network. The data is extracted directly from communications in a cellular network without using any external sensors. The method enables correlating a car to a road it travels on and determining its speed by using only the partial data that arrives to the cellular switch. The method consists of the following stages: A learn phase, which can include a vehicle (s) with a location device (say GPS system) travels across the covered routes within a designated area and collects the cellular data (cell handover sequences and signal strength reports) and location data in parallel. The accumulated data is then analyzed and processed to create the reference database. An operational stage is provided in which communications on the cellular network control channel are monitored continuously, and matched against the reference database in order to locate their route and speed. The route and speed data is used in order to create a traffic status map within the designated area and alarm in real time on traffic incidents. The data analysis and data base structure are done in a manner that will enable the following: Very fast, high reliability initial identification of the vehicle's route in the operational stage, based on handovers' cell ID only, very fast, high reliability follow up forward and backwards of the vehicle's route in the operational stage, and real time, high reliability Incident detection.

A fourth class of systems requires the knowledge of the identifiers of the cells in which the subscribers of the mobile telephony network make their calls. A system that needs this type of information is for example described in EP 0763807. This document discloses an estimation of traffic conditions on roads located in the radio coverage areas of a wireless communications network based on an analysis of real-time and past wireless traffic data carried on the wireless communications network. Data analyzed may include, for example, actual (current) and expected (past average) number of a) active-busy wireless end-user devices in one or more cells at a particular period of time, b) active-idle wireless end-user devices registered in a location area of the wireless communications network, c) amount of time spent by mobile end-user devices in one or more cells at a particular period of time.

A fifth class of systems requires the knowledge of the location area in which the subscribers of the mobile telephony network are situated. A system that requires this type of information is for instance described in WO 03/041031 A1. This document relates to collecting of traffic data with the aid of a mobile station network. Such areas are determined in the mobile station network, wherein the terminal equipment communicates with the network with the aid of one or more predetermined messages. Based on the message between the network and terminal equipment and relating to a first area a first time by the clock is stored, and based on the message between the network and the same terminal equipment and relating to a second area a second time by the clock is stored. The times by the clock are used in order to obtain traffic data by calculating, for example, the time spent on moving from one area to another. By determining the distance between areas along the road it is possible also to determine the speed of the vehicle. Information may also be collected to form a statistic distribution.

U.S. Pat. No. 6,587,781 discloses a method and system for modeling and processing vehicular traffic data and information, comprising: (a) transforming a spatial representation of a road network into a network of spatially interdependent and interrelated oriented road sections, for forming an oriented road section network; (b) acquiring a variety of the vehicular traffic data and information associated with the oriented road section network, from a variety of sources; (c) prioritizing, filtering, and controlling, the vehicular traffic data and information acquired from each of the variety of sources; (d) calculating a mean normalized travel time (NTT) value for each oriented road section of said oriented road section network using the prioritized, filtered, and controlled, vehicular traffic data and information associated with each source, for forming a partial current vehicular traffic situation picture associated with each source; (e) fusing the partial current traffic situation picture associated with each source, for generating a single complete current vehicular traffic situation picture associated with entire oriented road section network; (f) predicting a future complete vehicular traffic situation picture associated with the entire oriented road section network; and (g) using the current vehicular traffic situation picture and the future vehicular traffic situation picture for providing a variety of vehicular traffic related service applications to end users.

WO 07/077,472 discloses a road traffic monitoring system comprising: a first input (1*a*) for receiving position estimations of mobile terminals; a second input (1*b*) for receiving input specifications chosen depending on the type of service for which such monitoring is performed; and an output (1*d*) for generating road traffic maps, each road traffic map being associated with a set of territory elements and including, for each one of the territory elements, at least one mobility index of mobile terminals travelling within such territory element. Preferably, input specifications are chosen among at least two of the following parameters: territory element, territory element observation time slot, maximum allowable error on the estimation of said at least one mobility index.

SUMMARY OF THE INVENTION

The Applicant has observed the following about known systems that rely on cellular PLMNs.

The systems of the first class can be very precise, but they have the drawback of requiring that the mobile terminals and/or the mobile telephony network are able to perform measures of the signal received from the respective serving cell and from cells adjacent thereto; thus, the effectiveness of these systems strongly depends on the capabilities of the mobile terminals and/or the network apparatuses, and they are not generally applicable; also, these systems require the presence of a location server or of suitable location algorithms resident in the mobile terminals; moreover, they generate substantial data traffic in the network, because the time-variable locations of the mobile terminals have to be tracked; additionally, these systems cannot work when the mobile terminals of the subscribers on the circulating vehicles are turned off or in stand-by.

The second, third and fourth classes of systems exploit information normally available to a cellular PLMN, but nevertheless they have the drawbacks of being very inaccurate in presence of network cells of medium-large size, like those covering suburban and extraurban areas, where highways run, and of requiring that the phone calls be relatively long, in order to be able to derive a vehicle's followed path.

The systems of the fifth class also exploits information normally available to the cellular PLMN, but they are extremely inaccurate because the areas considered are very large and comprise several cells.

The Applicant has observed that none of the known methods and systems for estimating, monitoring and managing the road traffic is sufficiently flexible to be adaptable to the different possible types of information that may be available, both as far as the information made available by the cellular PLMN is concerned, and as regards the information made available by the conventional systems (manual and/or automatic vehicles counting, floating cars). In particular, the Applicant has observed that no method and system is known in the art that is capable of properly operating irrespective of the type of information derived from the cellular PLMN and made available by the conventional systems.

The Applicant has tackled the general problem of improving the known methods and systems for estimating, monitoring and managing road traffic.

In particular, the Applicant has tackled the problem of providing a traffic monitoring method and system that are more flexible compared to those known in the art, especially in term of the type of information they can use.

The Applicant has found that a solution to these problems can be a road traffic monitoring, estimation and management method, and a related system, which are adapted to receive in input information from at least one, e.g. two or more different information sources, the latter being for example a cellular PLMN and one of the conventional vehicles counting systems and/or the GPS receivers on-board of the floating cars, and to select an input information processing method among at least two possible information processing methods according to the type of information made available by the information sources, and based on predefined selection criteria; the predefined selection criteria may for example include the acceptable burden for obtaining the input information and for the data processing (computational burden), and the desired accuracy of the results provided by the monitoring method.

In other words, when more types of input information are available, deriving from conventional information sources and from a cellular PLMN, one of the possible information processing methods is selected, according to predefined criteria.

The method and system according to the present invention are capable of operating with any type of mobile terminal, with any type of cellular PLMN network apparatuses, produced by any manufacturer, with any cellular PLMN technology (GSM—Global System for Mobile communications—, GPRS—General Packet Radio Service—, UMTS—Universal Mobile Telecommunications System—, etc.), in a way that is independent from the specific location system (network-based, client-server) and the location technique (UL-TOA, E-OTD, CGI+TA, E-CGI+TA or other), and in any environment (large urban centers, extraurban areas, highways, etc.).

According to an aspect of the present invention, a method of estimating road traffic on a roads network is provided, comprising:

- receiving information from at least one information source, wherein the information received from the at least one information source is one among a first information type and a second information type;
- defining at least two different information processing methods, each one associated with a respective one of said information type;
- selecting the information processing method based on the available information type and on predefined criteria; and
- processing with the selected information processing method the corresponding available information type;
- providing an estimation of the road traffic based on the result of said processing.

Said at least one information source may include at least a first and a second distinct information sources, and wherein said defining at least two different information processing methods comprises associating with a respective combination of the information types received from the first and second information sources a respective information processing method.

Said first information source may include at least one cellular PLMN.

The information received from the first information source may comprise one or more among:

- a list of mobile terminals attached to the cellular PLMN, and identifiers of the macroareas where each mobile terminal in the list is situated;
- a list of mobile terminals attached to the cellular PLMN, and identifiers of the PLMN cells in which each mobile terminal in the list is situated while making a phone call, or while dispatching a message, or when a handover is performed;
- a list of mobile terminals attached to the cellular PLMN, and indications about the geographical positions within the respective PLMN cells of each mobile terminal in the list, at the time a phone call or a handover are performed;
- a list of mobile terminals attached to the cellular PLMN, and an indication of a trajectory of each mobile terminal in the list during a phone call.

Said second information source may include at least one among a manual or automatic vehicles counting system, and a system based on information received from a satellite localization system receiver on-board of at least a subset of circulating vehicles.

Said information received from the second information source may comprise one or more among:

- a list of geographic coordinates of the road sections in which manual or automatic vehicles counters are installed, and the number of vehicles counted by each counter in the list, and
- a list of vehicles equipped with satellite localization system receivers and indications about a trajectory thereof.

The method may comprise at least temporarily storing the information received from the first information source and the information received from the second information source in a database and arranging the information in a matrix form.

In said matrix form the different information types received from the first information source may be arranged in a matrix column, and the different information types received from the second information source are arranged in a matrix row.

The information may be arranged in said matrix column or row in order of increasing or decreasing complexity.

At an intersection of a matrix row and a matrix column, an identifier may be stored of the information processing method associated with the corresponding combination of information types available.

Said selection criterion may include a degree of accuracy of the estimation of the road traffic, an information processing time, the nature of the fruitor of the estimation of the road traffic, a price paid by the fruitor of the estimation of the road traffic, an arbitrary choice.

According to another aspect of the present invention, a system for the estimation of road traffic on a roads network is provided, adapted in use to:

- receiving information from at least one information source, wherein the information received from the at least one information source is one among a first information type and a second information type;
- defining at least two different information processing methods, each one associated with a respective type of information received from the at least one information source;
- selecting the information processing method based on the available type of information and on predefined criteria; and
- processing with the selected information processing method the corresponding available type of information;
- providing an estimation of the road traffic based on the result of said processing.

Said at least one information source may include at least a first and a second distinct information sources, and wherein said at least two different information processing methods comprises a respective information processing method associated with every combination of the information types received from the first and second information sources.

Said first information source may include at least one cellular PLMN.

The information received from the first information source may comprise one or more among:

- a list of mobile terminals attached to the cellular PLMN, and identifiers of the macroareas where each mobile terminal in the list is situated;
- a list of mobile terminals attached to the cellular PLMN, and identifiers of the PLMN cells in which each mobile terminal in the list is situated while making a phone call, or while dispatching a message, or when a handover is performed;
- a list of mobile terminals attached to the cellular PLMN, and indications about the geographical positions within the respective PLMN cells of each mobile terminal in the list, at the time a phone call or a handover are performed;
- a list of mobile terminals attached to the cellular PLMN, and an indication of a trajectory of each mobile terminal in the list during a phone call.

Said second information source may include at least one among a manual or automatic vehicle counting system, and a system based on information received from a satellite localization system receiver on-board of at least a subset of circulating vehicles.

Said information received from the second information source may comprise one or more among:

- a list of geographic coordinates of the road sections in which manual or automatic vehicles counters are installed, and the number of vehicles counted by each counter in the list, and
- a list of vehicles equipped with satellite localization system receivers and indications about a trajectory thereof.

The system may comprise a database wherein the information received from the first information source and the information received from the second information source are at least temporarily stored arranged in a matrix form.

In said matrix form the different information types received from the first information source may be arranged in a matrix column, and the different information types received from the second information source are arranged in a matrix row.

The information may be arranged in said matrix column or row in order of increasing or decreasing complexity.

At an intersection of a matrix row and a matrix column, an identifier may be stored of the information processing method associated with the corresponding combination of information types available.

Said selection criterion may include a degree of accuracy of the estimation of the road traffic, an information processing time, the nature of the fruitor of the estimation of the road traffic, a price paid by the fruitor of the estimation of the road traffic, an arbitrary choice.

BRIEF DESCRIPTION OF THE DRAWINGS

These and other features and advantages of the present invention will be made clear by the following detailed description of an embodiment thereof, provided merely by way of non-limitative example, made with reference to the attached drawings, wherein.

DETAILED DESCRIPTION OF PREFERRED EMBODIMENTS OF THE INVENTION

Figure 1:
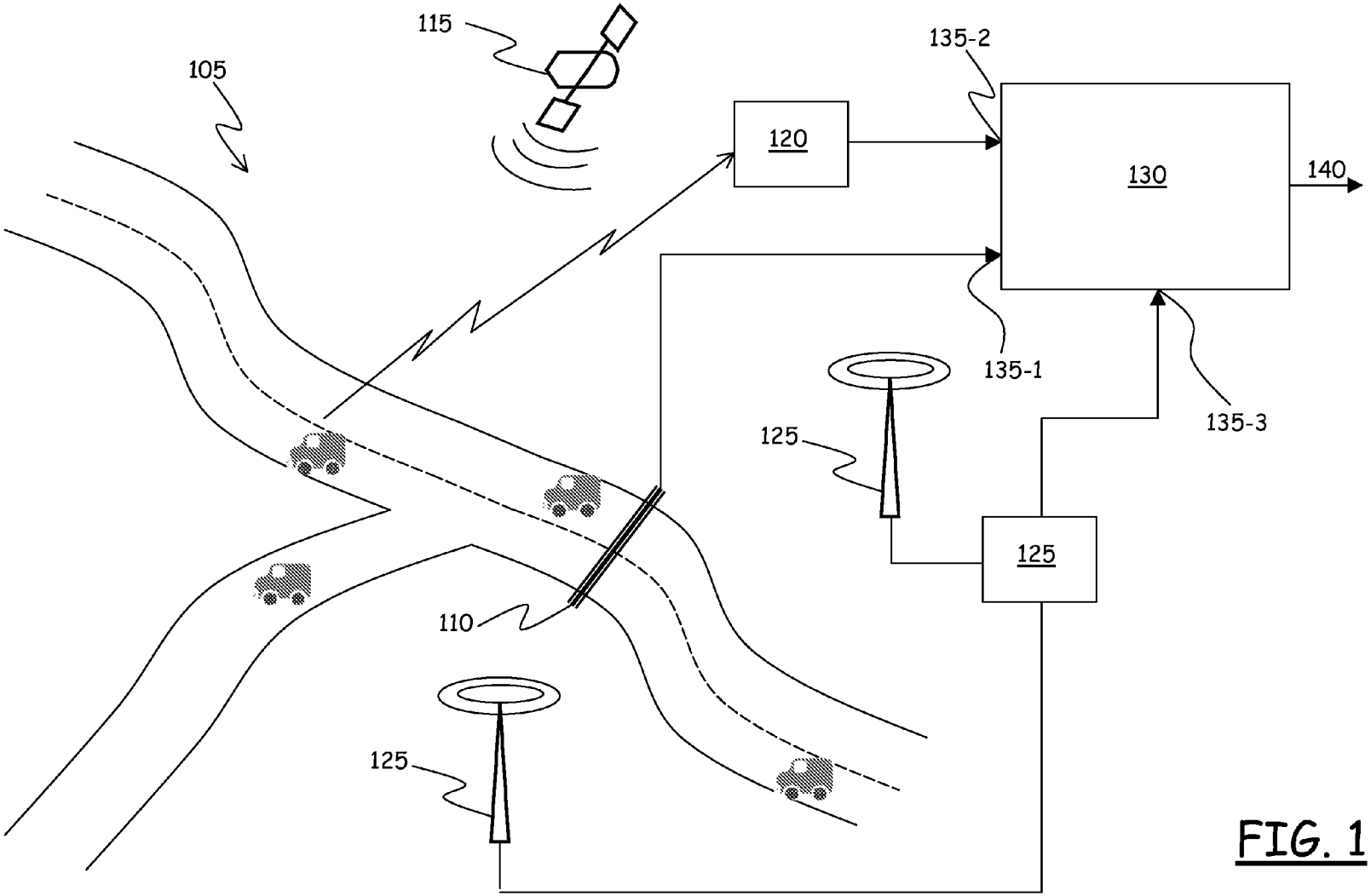
FIG. 1 synthetically shows a system according to an embodiment of the present invention, and a possible use scenario.

Making reference to the drawings, in FIG. 1 a system according to an embodiment of the present invention is synthetically shown, together with a possible use scenario.

Reference numeral 105 denotes a network of roads, which may be or include one or more among streets of a town, extraurban roads, highways or the like.

Reference numeral 110 is intended to denote one or more of conventional vehicles counting systems, like for example a manual vehicle counting system and/or an automatic vehicle counting system (for example, a system using rubber pipes, and/or metal coils and/or television cameras physically arranged along the roads to be monitored).

Reference numeral 115 denotes the GPS (i.e., the constellation of satellites orbiting around the Earth, and all the Earth-based apparatuses for their operation); vehicles equipped with GPS receivers (not shown in the drawing for the sake of clarity) may regularly transmit to a service center 120 their position and speed.

Reference numeral 125 denotes a cellular PLMN (hereinafter simply referred to as the PLMN 125), like for example a GSM, a GPRS, a UMTS or equivalent network.

Block 130 schematizes a system according to an embodiment of the present invention for estimating and/or monitoring and/or managing road traffic (hereinafter shortly referred to as the traffic monitoring system 130). The traffic monitoring system 130 has information inputs, schematized in the drawings as 135-1 and 135-2, for receiving information from conventional information sources like the manual and/or automatic vehicle counting system 115, and from the service center 120. The traffic monitoring system 130 has additional information inputs, schematized in the drawing as 135-3, for receiving information from the PLMN 125 (more generally, the system 130 may receive information from two or more PLMNs). The system 130 has an output 140 at which road traffic estimation and/or monitoring and/or managing information are made available.

Figure 2:
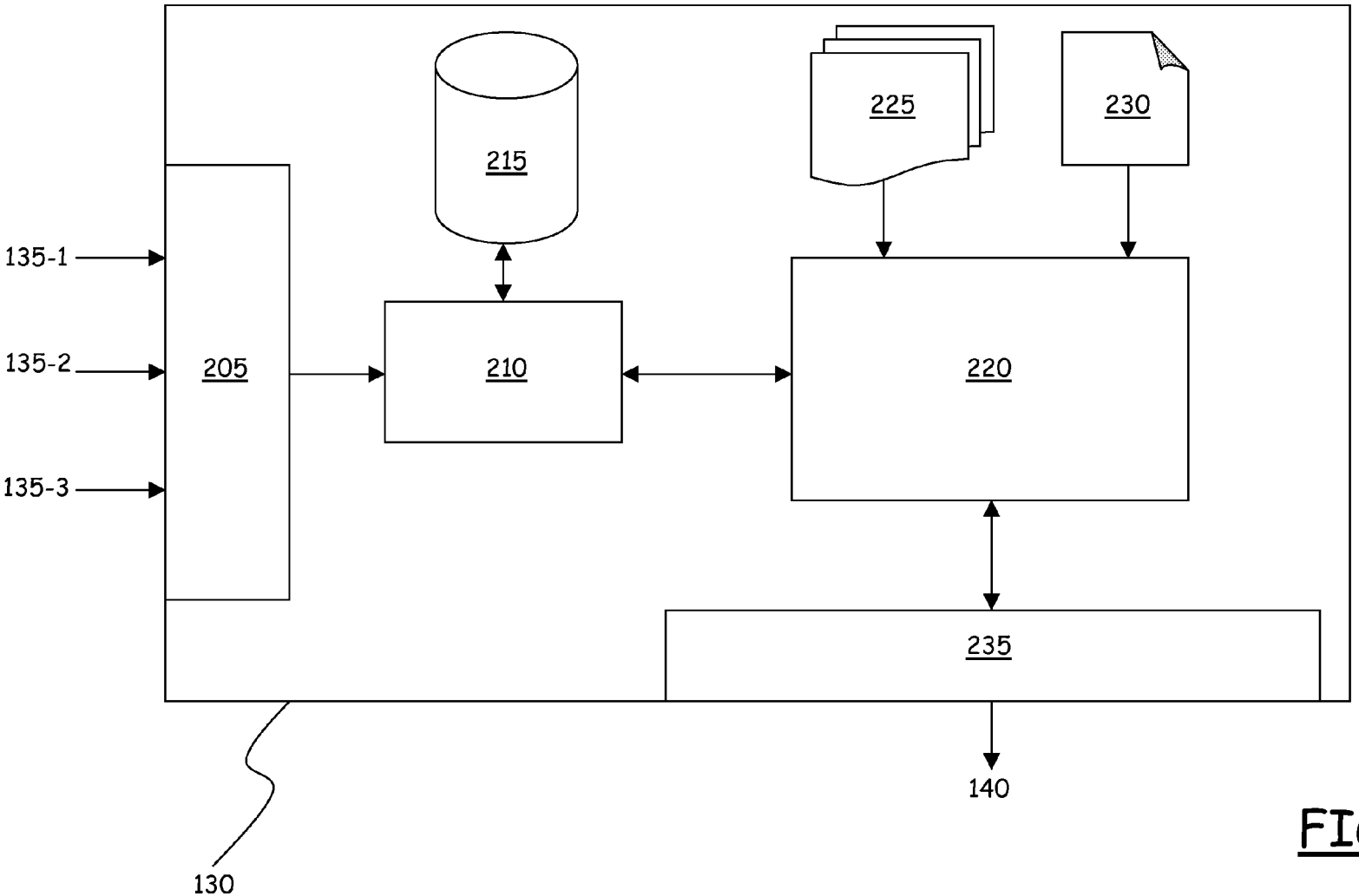
FIG. 2 schematically shows, in terms of functional blocks, a more detailed view of the system of FIG. 1, according to an embodiment of the present invention.

The structure of the traffic monitoring system 130 according to an embodiment of the present invention is shown schematically but in greater detail in FIG. 2. The structure of the traffic monitoring system 130 is depicted in terms of functional blocks, each of which may be implemented in hardware or software or as a mix of hardware and software.

The traffic monitoring system 130 comprises an information input interface 205 adapted to manage the receipt (at the information inputs 135-1, 135-2 and 135-3), information from different possible information sources, like the manual and/or automatic vehicle counting system 110, the service center 120 and the PLMN 125. The information received by the information input interface 205 are passed to an information database manager 210, adapted to manage a database 215 where the information received from the different possible information sources are at least temporarily stored. The database manager 210 also offers its services to an information processing engine 220, adapted to process the information coming from the different possible information sources and stored in the database 215 according to one or more information processing methods, which are selected by the processing engine 220 from a library 225 of available information processing methods, the selection being made based on predefined selection criteria 230. A user-machine interface 235 is also provided, for allowing the interaction of the system 130 with human users, for example for providing thereto the output information, and for system management purposes.

The information received in input by the traffic monitoring system 130 can classified in two categories: information provided by conventional traffic calculation systems (where by "conventional traffic calculation systems" it is intended manual and/or automatic vehicles counting systems, like the system 110, and systems 115 based on floating cars with GPS receivers, more generally systems different from cellular PLMNs) and information provided by one or more PLMNs (like the PLMN 125).

The first category of information may include:

information deriving from manual and/or automatic vehicles counters, that consists in the number of vehicles that, in a selected, reference time unit (e.g., 15 minutes) transit on a certain section of a road;

information deriving from the GPS receivers on-board of floating cars, that is for example constituted by a sequence of geographical positions (coordinates x, y) taken by the floating cars while moving, and the relative speeds of the floating cars.

The second category of information may include:

indications about the macroareas (for instance, Location Areas or Routing Areas) in which the mobile terminals of the users within the vehicles are situated, when they are in stand-by;

identifiers of the network cells in which the mobile terminals of the users within the vehicles are situated (i.e., the network cells to which the mobile terminals are attached) when a call is started, a message (e.g., a Short Message Service—SMS message or a Multimedia Message Service—MMS-message) is sent or a handover (change of serving network cell) is performed;

the geographical position (coordinates x, y) of the mobile terminals of the users within the vehicles within the respective network cells when a call is started, an SMS or MMS message is sent, etc., or when a handover is performed;

the complete trajectory of the mobile terminals of the users within the vehicles during a call, that is, the sequence of geographical positions (coordinates x, y) of the mobile terminals measured at regular time intervals by means of any known or possible location technique.

More specifically, at the input 135-1 the traffic monitoring system 130 can for example receive the following information types:

1) the list of geographic coordinates of the road sections in which the manual and/or automatic vehicles counters are installed, and the number of vehicles counted by each counter in the list.

At the input 135-2 the traffic monitoring system 130 can for example receive the following information:

2) the list of floating cars and the complete trajectory of each floating car in the list, that is, the sequence of geographical positions (coordinates x, y) of each of the floating cars measured at regular time intervals by means of the GPS.

The information received is stored in the database 215, where the relevant data are preferably listed in terms of one or more among: increasing burden necessary to obtain the information (obtaining information type 2) poses a higher burden than obtaining information type 1)); information processing burden, i.e. of computation burden for processing the information for the purposes of monitoring, estimating, managing the road traffic (processing data related to information type 2) is more complex than processing data related to information type 1)); and accuracy of the road traffic monitoring, estimation, managing results that the traffic monitoring system 130 can provide (the accuracy of the results is greater when information type 2) is available compared to when information type 1) is available).

The traffic monitoring system 130 can also receive any possible combination of information types 1) and 2), for instance the list of geographic coordinates of the road sections where the manual and/or automatic vehicles counters are installed and number of vehicles counted by each counter in the list, and list of floating cars with complete trajectory of each floating car in the list.

At the input 135-3 the traffic monitoring system 130 can for example receive the following information types:

3) list of mobile terminals of users within the vehicles moving in the roads network being monitored, and identifiers of the macroareas where each mobile terminal in the list is situated; the macroarea identifiers can be represented by alphanumeric codes or by the geographical coordinates (x, y) of the macroarea centers of mass;

4) list of mobile terminals of users within the vehicles moving in the roads network being monitored, and identifiers of the PLMN cells in which each mobile terminal in the list is situated while making a phone call, or while dispatching an SMS and/or MMS message, or when a handover is performed; the cell identifiers can be represented by alphanumeric codes or by the geographical coordinates (x, y) of the cells' centers of mass;

5) list of mobile terminals of users within the vehicles moving in the roads network being monitored, and geographical position (coordinates x, y) within the respective PLMN cells of each mobile terminal in the list, at the time they perform a phone call or a handover;

6) list of mobile terminals of users within the vehicles moving in the roads network being monitored, and complete trajectory of each mobile terminal in the list during a call, that is, the sequence of geographical positions (coordinates x, y) of the mobile terminals measured at regular time intervals by means of any known or possible location technique.

The information received is stored in the database 215, where the relevant data are preferably listed in terms of one or more among: increasing burden necessary to obtain the information (increasing from information type 3) to information type 6)); information processing burden (increasing from information type 3) to information type 6)); and accuracy of the road traffic monitoring, estimation, managing results that the traffic monitoring system 130 can provide (increasing from information type 3) to information type 6)).

The types of information that is provided by the PLMN 125 may depend on the characteristics of the mobile terminals, on the functionalities of the network apparatuses and on the presence in the PLMN core network of specific, ad-hoc apparatuses. For example, not all the mobile terminals may be able to perform the measures necessary to their localization (information types 5) and 6)), not all the network apparatuses may have the additional functionalities necessary in some cases for the localization of the mobile terminals (information types 5) and 6)), not all the network apparatuses may be able to extract from the communication protocols, and to send to the traffic monitoring system 130, information about the macroarea or the cell in which a generic mobile terminal is situated (information types 3) and 4)), or not all the PLMNs may have a localization system capable of exploiting the measures performed by the mobile terminals or the network apparatuses (information types 5) and 6)), etc.

The traffic monitoring system 130 may also receive any possible combination of two or more of the information types 3), 4), 5) and 6). For example, further types of information made available may be:

7) a first list of mobile terminals (a first subset of all the mobile terminals attached to the PLMN 125) and identifiers of the macroareas where each mobile terminal in the first list is situated, and a second list of mobile terminals (a second subset of all the mobile terminals attached to the PLMN 125) and geographical position (coordinates x, y) inside the respective cell of each mobile terminal in the second list at the time a call is made or a handover is performed;

8) a third list of mobile terminals (a third subset of all the mobile terminals attached to the PLMN 125) and the identifiers of the macroareas where each mobile terminal in the third list is located, a fourth list of mobile terminals (a fourth subset of all the mobile terminals attached to the PLMN 125) and the identifiers of the cells in which each mobile terminal in the fourth list is located while making a phone call, or while dispatching an SMS or MMS message, or at the time a handover is performed, a fifth list of mobile terminals (a fifth subset of all the mobile terminals attached to the PLMN 125) and the complete trajectory of each mobile terminal in the fifth list while they are engaged in a phone call;

The information from the different possible information sources (manual and/or automatic vehicles counting systems, floating cars, PLMN(s)) can be received by the traffic monitoring system 130 at regular, discrete time intervals Δt, or continuously. In this latter case, the traffic monitoring system 130 can organize the received data in temporal blocks, based on the type of output to be provided. The traffic monitoring system 130 may, in some time intervals Δt, receive no information on any of the information inputs 135-1, 135-2 or 135-3, for example it may receive no information from the PLMN 125. In the case in which, in the time interval Δt, one or more of the mobile terminals has changed macroarea, has placed more than one call or performed more than one handovers, etc., that or those mobile terminals may appear several times within the lists of macroareas or cells identifiers or positions of the different cells. To each information element in each of the above-mentioned lists, a time indication may be associated adapted to indicate the time instant at which the event (phone call, handover, etc.) occurred.

The traffic monitoring system 130 can also exploit information provided by different vehicles traffic monitoring apparatuses, like for example systems that use lasers positioned in fixed points of the roads network to measure the vehicles speed.

The traffic monitoring system 130 is adapted to process the information received from the different information sources to provide in output one or more of the following:

- indications about the presence of an accident or of a traffic jam in the generic road section;
- average speed along all the road sections of the monitored roads network, or along a subset thereof, selected by the system administrator in a phase of configuration of the traffic monitoring system 130;
- trip time along any route on the roads network (a route is identified by a starting point and by an arrival point), set by default by the system administrator or selected required by a customer of the traffic monitoring system 130;
- flows of vehicles along all the road sections of the monitored roads network, or along a subset thereof selected by the system administrator in the system configuration phase;
- identification of the route with the minimum trip time among a starting and an arrival points set by default by the system administrator or selected by a consumer.

Figures 3, 4:
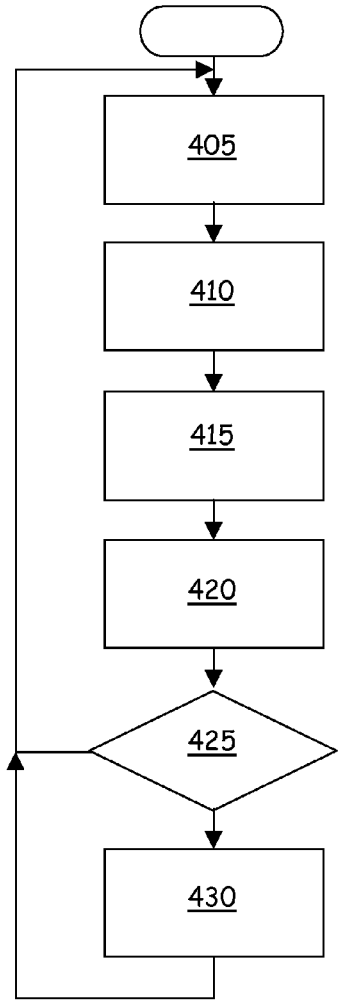
FIG. 3 schematically shows a tabular arrangement of data according to an embodiment of the present invention.
FIG. 4 schematically shows the main steps of a possible information processing method, according to an embodiment of the present invention.

FIG. 3 schematizes the way information received in input by the traffic monitoring system 130 is arranged in the database 215, according to an embodiment of the present invention.

In particular, the data are logically organized in the form of one or more matrices like the matrix 305. In the first row of the matrix 305, data related to the information received from the conventional systems (manual and/or automatic vehicles counting systems, floating cars) are stored; in the shown example, matrix element $\mathbf{310}_{12}$ (first row, second column of the matrix 305) stores the data provided by the manual and/or automatic vehicles counting system 110, the matrix element $\mathbf{310}_{13}$ (first row, third column of the matrix 305) stores the data provided by the floating cars, and the matrix element $\mathbf{310}_{14}$ (first row, fourth column of the matrix 305) stores data related to combined information provided by both the manual and/or automatic vehicles counting system 110 and the floating cars (in the hypothesis that both these information sources are available). In the first column of the matrix 305, data related to the information received from the PLMN 125 are stored; in the shown example, the matrix element $\mathbf{310}_{21}$ (second row, first column of the matrix 305) data related to the information type 3) described above are stored; in the matrix element $\mathbf{310}_{31}$ (second row, second column of the matrix 305) data related to the information type 4) described above are stored; in the matrix element $\mathbf{310}_{41}$ (fourth row, first column of the matrix 305) data related to the information type 5) described above are stored; in the matrix element $\mathbf{310}_{51}$ (fifth row, first column of the matrix 305), data related to the information type 6) described above are stored; in the matrix element $\mathbf{310}_{61}$ (fifth row, first column of the matrix 305), data related to the combination of information type 7) described above are stored; and in the matrix element $\mathbf{310}_{71}$ (seventh row, first column of the matrix 305), data related to the combination of information type 7) described above are stored.

The generic matrix element $\mathbf{310}_{ij}$, where i=2, . . . , 7 and j=2, . . . , 4 of the matrix 305 stores an identifier of a respective information processing method that the processing engine 220 shall use to process the data stored in the associated matrix elements $310_{1j}$ and $310_{i1}$. In the drawing, these information processing methods are denoted a1 to a6, b1 to b4, and c1 to c6. The generic information processing method is tailored on the specific set of data available for being processed. The complexity, and consequent precision, of the information processing methods increases going from method a1 to method c6.

It is intended that the data may be arranged in other forms, for example other matrix forms; for example, the data may be arranged in decreasing, instead of increasing, order of completeness and of complexity of the processing methods, or they may even be not ordered in any particular way.

In the case only one type of input information, from either one of the possible information sources, is available, the processing engine 220 automatically selects the information processing method corresponding to received information. For instance, if the traffic monitoring system receives only the information type 1) and the information type 3), the processing engine 220 automatically selects the processing method a1 (no other choice is available). The same occurs if information from one of the possible information sources are (at least temporarily) missing, for example from one of the conventional information sources like the manual and/or automatic vehicle counting system 115, and from the service center 120, or from the PLMN 125.

In the case instead in which the traffic monitoring system 130 has several information types available, it can in principle use two or more of the possible processing methods, the processing engine 220 may select the processing method to be used based on predetermined criteria. For example, the system administrator can define a function (cost function) adapted to assign a value to each information processing method; in operation, the information processing method selected by the processing engine 220 will be the one that satisfies the cost function. Such function may for example be a numerical representation of the following processing method selection criteria.

Accuracy of the results provided in output by the traffic monitoring system: if it is desired to have a high accuracy in the results provided by the system, the processing engine 220 selects, among all the available processing methods, the one that is able to provide the most accurate result (irrespective of other choice factors). With reference to the matrix of FIG. 3, the processing engine 220 selects the processing method identified in the matrix element in the rightmost column and in the lowermost row of the matrix 305, in the shown example the method c6 (this is valid in the hypothesis that, in the matrix 305, the data have been sorted in increasing order of completeness). Indeed, since the generic PLMN cell covers an area that is smaller than that covered by a macroarea, the use of the PLMN cell to indicate the position of the mobile terminal provides a more accurate result compared to the use of the macroarea; similarly, exploiting the knowledge of the exact position where a handover occurred provides a more precise result compared to exploiting the location of the PLMN cell, and so on. For similar reasons, the GPS gives a more accurate information compared to that provided by vehicles counters. The more accurate the knowledge of the mobile terminals' positions, the more accurate the estimation of the traffic. In general, the association between the accuracy of the output result and the processing method is made by the system administrator in the configuration phase.

Answer time: if it is desired to reduce the time needed by the traffic monitoring system 130 to provide an output result, the processing engine 220 selects, among all the available information processing methods, the one capable of providing the result in the shortest time, irrespective of the other factors of choice. With reference to the matrix of FIG. 3, the processing engine selects the processing method indicated in the matrix element in the leftmost column and in the higher-most row, because moving down in the matrix 305 the amount of data to process increases (for instance, the processing methods in the fourth matrix row need to process whole trajectories in comparison to methods in the third matrix row, which process single positions, etc.), thus more processing time is needed to the system to provide the output results. Also in this case, the association between the answer time and information processing method can be made by the system administrator in the configuration phase.

Type of output result: if the output to be provided by the traffic monitoring system consists simply in a warning to be issued in case of an accident or a traffic jam, it can be sufficient to use an information processing method exploiting the knowledge of the identifiers of the PLMN cells, like for example the method a3 (in order to determine that the traffic is blocked in a certain area and to issue a corresponding warning, an algorithm is sufficient that uses only the information on the macroareas or the cells in which the mobile terminals are situated; the knowledge of the trajectories would provide an increased accuracy, but sometimes it might be superfluous.). If instead it is desired to have an indication about the flow of the vehicles on the whole roads network, it might be preferable to use processing methods exploiting the knowledge of the trajectories of the mobile terminals, like for example the processing method a6. In general, the system administrator may be responsible of establishing the association between the types of output and processing method to be used.

Intended recipient of the output result: if the output result is intended for providing an information service to drivers, it might be sufficient to exploit a processing method that is not particularly accurate by is fast in terms of answer time; if instead the output result is intended for use by a public administration for the medium-long term planning of the public transports in a certain area, the processing engine 220 preferably selects an accurate, even if slower, processing method.

Price paid for the services provided by the traffic monitoring system: a cost can be assigned to every processing method, based on the accuracy of the output result, the processing times, the amount of input data needed; the processing engine 220 can also select the processing method based on the price that the subscriber of the traffic monitoring system 130 has agreed to pay.

The choice of the information processing method to be used may also be made arbitrarily by the system administrator, overriding any other selection criterion.

It is worth pointing out that the present invention is not limited to any specific cost function adopted by the system administrator. For instance, in the case in which the cost function represents the accuracy of the output, it can be designed in such a way to assign the value 1 to the method a1, the value 2 to the method c1, the value 3 to the method a2, etc. up to the value 12 to the method C6.

The traffic monitoring system 220 of the present invention is not limited to the specific information processing methods used by the processing engine. Nevertheless, merely by way of example, in the following of the present description, some information processing methods will be described in detail, that the processing engine 220 can select to process the information stored in the database 215.

First Information Processing Method (Method a1)

Input data used by this method are the list of mobile terminals and the identifier of the macroarea where each of the mobile terminals in the list is located, and the list of coordinates of the road sections whereat the manual and/or automatic counting of the vehicles numbers are performed, and the respective vehicles count. The method involves the following sequence of operations, schematized in the flowchart of FIG. 4:

Step 405—After the start, the system receives (at the input 135-3) information from the PLMN;

Step 410—The system also receives (at the input 135-1) information about the vehicle counts from the manual and/or automatic counting systems deployed on the road network;

Step 415—for every macroarea i, the processing engine 220 calculates the number Ni of terminals that are located thereat in the time interval Δt;

Step 420—for every road section j at the boundary of the macroarea i, the processing engine 220 counts the number Aej of vehicles entering into the macroarea, and the number Alj of vehicles leaving the macroarea;

Step 425—the processing engine 220 assesses whether both the number of terminal Ni and the result of the formula $$\left(\sum_j Aej - \sum_j Auj\right)$$

(total number of vehicles entering the macroarea minus the total value of vehicles leaving the macroarea) exceed two respective predetermined thresholds Si and ΔA); in the affirmative case, the method proceeds to step 430, otherwise it jumps back to the beginning (step 405);

Step 430—the system provides in output the indication of a traffic jam in the considered macroarea, and jumps back to the beginning (405) for the next time interval Δt;

Second Information Processing Method (Method a2)

Figure 5:
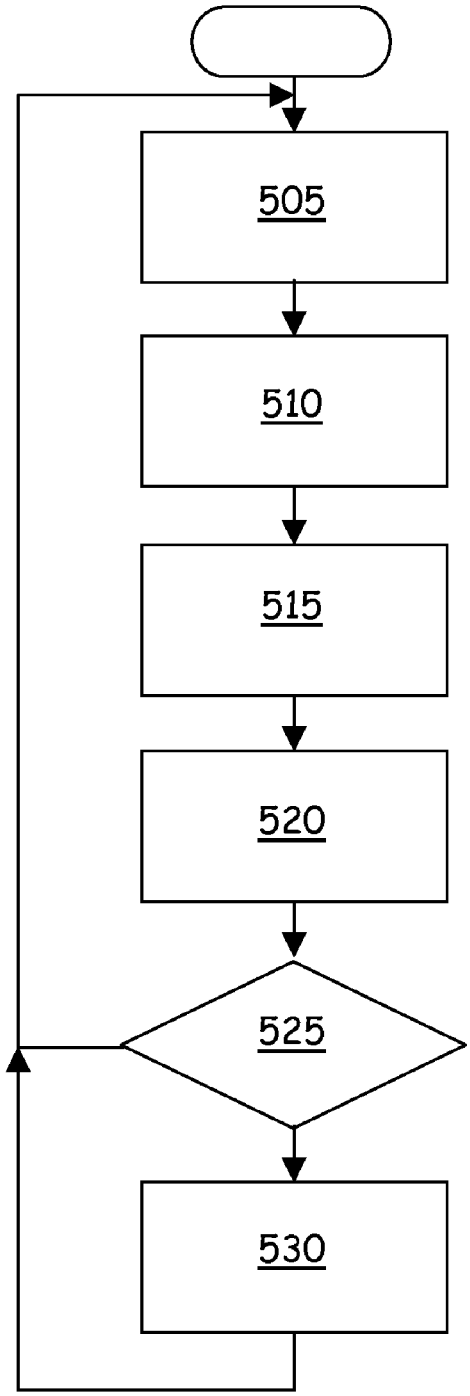
FIG. 5 schematically shows the main steps of another possible information processing method, according to an embodiment of the present invention.

This method uses as input data the list of mobile terminals and the identifier of the cell in which each of them was located at the time a call was performed, or a (SMS or MMS) message was dispatched, etc., or at the time a handover occurred, and the list of coordinates of the road sections where the manual and/or automatic counting systems are installed, and the number of vehicles counted. The method involves the following sequence of operations, schematized in the flowchart of FIG. 5:

Step 505—after the start, the system it receives (at the input 135-3) information from the PLMN;

Step 510—the system receives (at the input 135-1) information from the manual and/or automatic counting systems;

Step 515—for each cell i of the PLMN, the processing engine 220 calculates the number of mobile terminals Ni that, in the considered time interval Δt; are located therein;

Step 520—for each road section j at the boundary of the cell i, the processing engine 220 counts the number Aej of vehicles entering into the cell, and the number Alj of vehicles leaving the cell;

Step 525—the processing engine assesses whether the number of mobile terminals Ni and the result of the formula $$\left(\sum_j Aej - \sum_j Auj\right)$$

(total number of vehicles entering the macroarea minus the total value of vehicles leaving the macroarea) exceed respective predetermined thresholds Si and ΔA); in the affirmative case, the method proceeds to step 530, otherwise the method jumps back to the beginning (step 505);

Step 530—the system provides in output the indication of a traffic jam in the cell i, and the method jumps back to the beginning (step 505) for the next time interval Δt.

Third Information Processing Method (Method a3)

Figure 6:
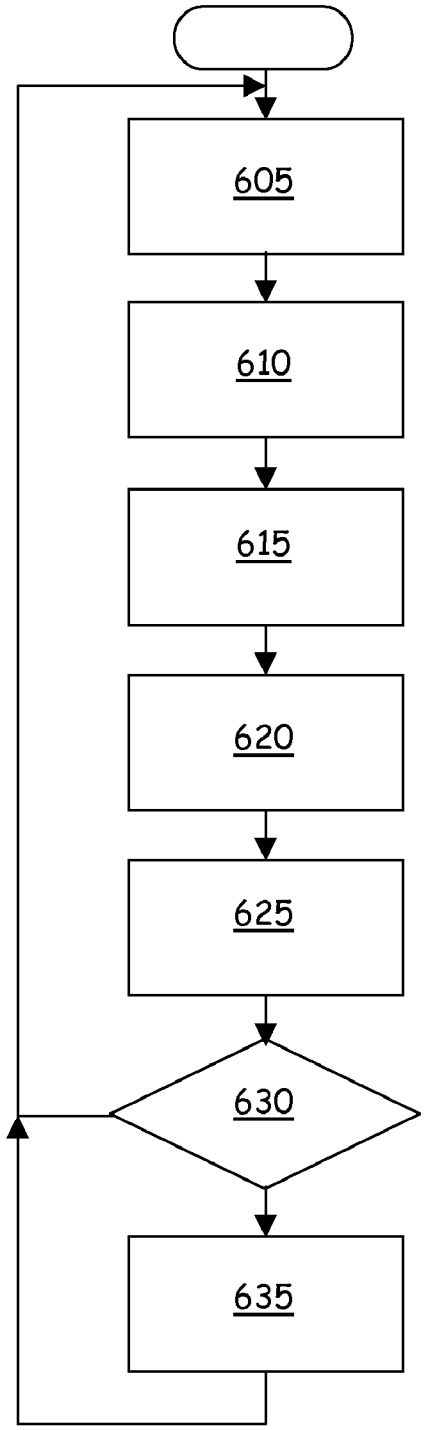
FIG. 6 schematically shows the main steps of another possible information processing method, according to an embodiment of the present invention.

This method uses as input data the list of mobile terminals and the geographical position (coordinates x, y) of each of them at the moment in which the mobile terminals place a call or perform a handover, and the list of coordinates of the road sections where the manual and/or automatic counting systems are installed, and the number of vehicles counted. The method involves the following sequence of operations, schematized in the flowchart of FIG. 6:

Step 605—after the start, the system receives (at the input 135-3) information from the PLMN;

Step 610—the system receives (at the input 135-1) information from the manual and/or automatic counting systems;

Step 615—the processing engine 220 divides the area of interest in area elements, for example of square shape, of predetermined size;

Step 620—for each area element i, the processing engine 220 calculates the number of terminal Ni that are located therein in the time interval Δt;

Step 625—for each road section j at the boundary of the area element i, the processing engine 220 counts the number Aej of vehicles entering into the area element, and the number Alj of vehicles leaving the area element;

Step 630—the processing engine 220 assesses whether the number of mobile terminals Ni and the result of the formula $$\left(\sum_j Aej - \sum_j Auj\right)$$

(total number of vehicles entering the area element minus the total number of vehicles leaving the area element) exceed respective predetermined thresholds Si and ΔA); in the affirmative case, the method proceeds to step 635, otherwise the method jumps back to the beginning (step 605);

Step 635—the system provides in output the indication of a traffic jam in the area element i, and the method jumps back to the beginning (step 605) for the next time interval Δt.

Fourth Information Processing Method (Method a4)

Figure 7:
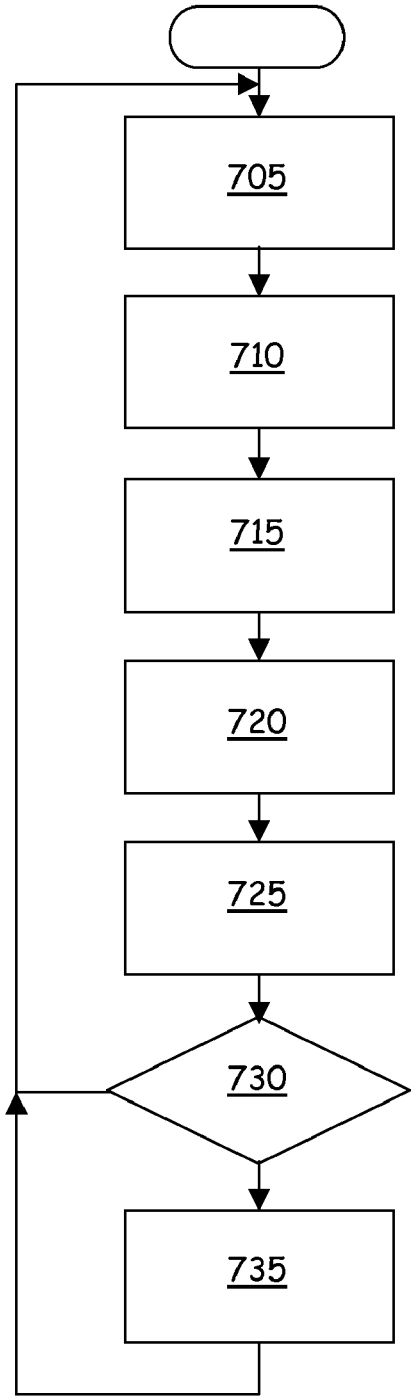
FIG. 7 schematically shows the main steps of another possible information processing method, according to an embodiment of the present invention.

This method uses as input data the list of mobile terminals and the complete trajectory of each of them during a call, and the list of coordinates of the road sections where the manual and/or automatic counting systems are installed, and the number of vehicles counted. The method involves the following sequence of operations, schematized in the flowchart of FIG. 7:

Step 705—after the start, the system receives (at the input 135-3) information from the PLMN;

Step 710—the system also receives (at the input 135-1) information from the manual and/or automatic counting systems;

Step 715—the processing engine 220 identifies the roads (or road sections) to be monitored within the area of interest;

Step 720—for every road i to be monitored, the processing engine 220 calculates the number Ni of mobile terminals that, in the time interval Δt are located thereat;

Step 725—for every road section j at the ends of the road i, the processing engine 220 counts the number Aej of vehicles entering into the road, and the number Alj of vehicles leaving the road;

Step 730—the processing engine 220 assesses whether the number of mobile terminals Ni and the result of the formula $$\left(\sum_j Aej - \sum_j Auj\right)$$

(total number of vehicles entering the road minus the total number of vehicles leaving the road) exceed respective predetermined thresholds Si and ΔA; in the affirmative case, the method proceeds to step 735, otherwise the method jumps back to the beginning (step 705);

Step 735—the system provides in output the indication of a traffic jam in the road i and the method jumps back to the beginning (step 705) for considering the next time interval Δt.

In any of the methods described above, the value of the two thresholds Si and ΔA can be set by the system administrator, or it can be automatically calculated by the processing engine 220, for example using predetermined, empirical formulas and based on the monitoring of the traffic for a certain period of time. Moreover, having in the database 215 the coordinates that identify all the roads, by associating every road to a macroarea, to a PLMN cell or to an area element, the information about the traffic jam can be provided at the level of single road.

Still by way of example, hereinafter some possible methods will be described for calculating the average vehicles' speed on road sections, which exploit information coming from vehicles equipped with GPS receivers and of the information derived from the PLMN.

Sixth Information Processing Method (Method b1)

Figure 8:
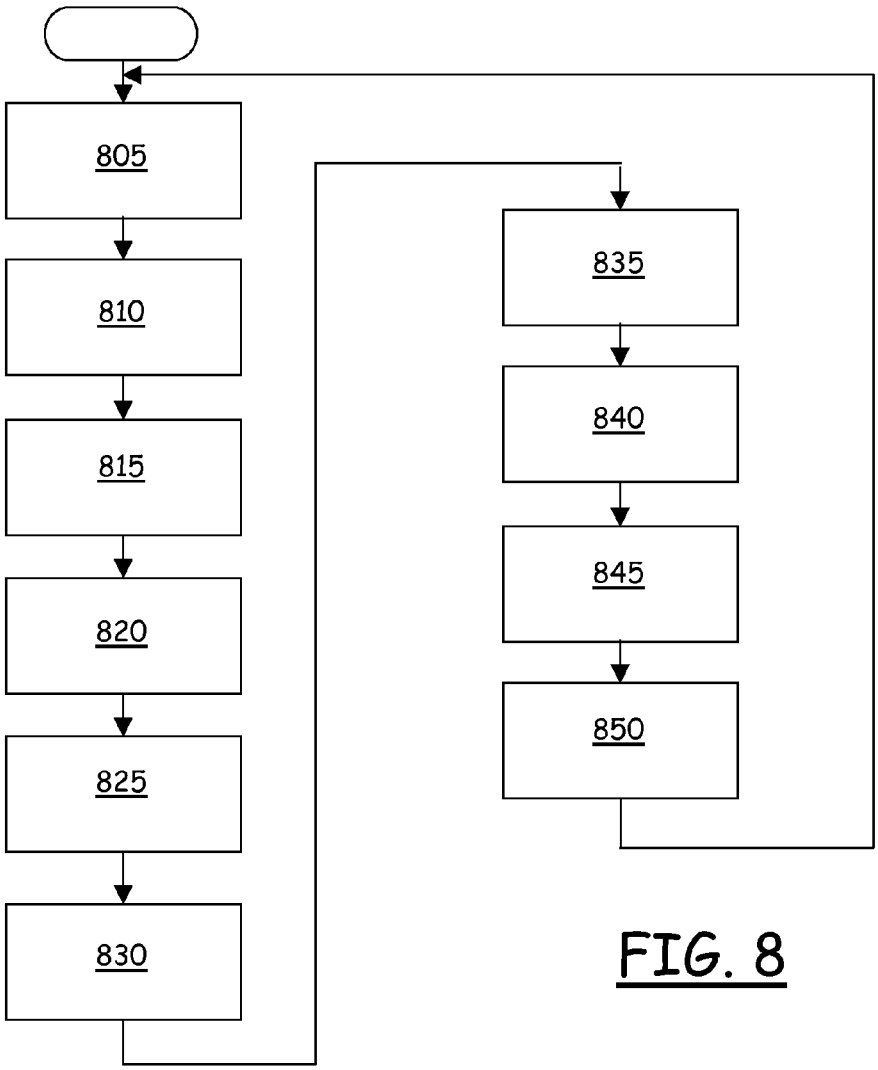
FIG. 8 schematically shows the main steps of another possible information processing method, according to an embodiment of the present invention.
Figure 9:
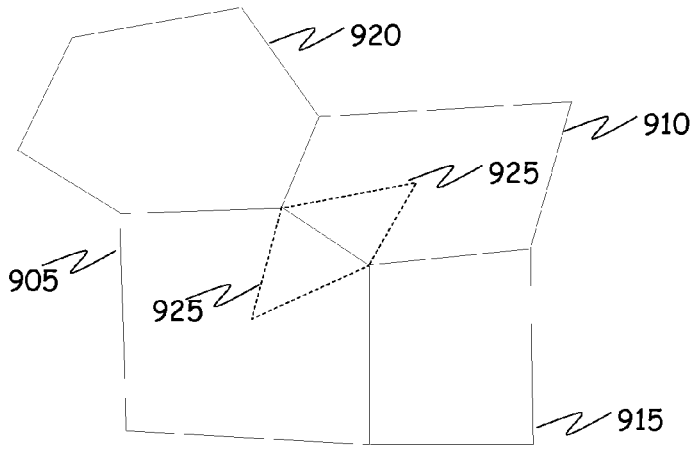
FIG. 9 schematically shows an exemplary subdivision into sub-areas of macro areas adopted in the method of FIG. 7.

This method uses as input data the list of mobile terminals and the identifier of the macroarea where each of the mobile terminals in the list is located, and the list of floating cars, i.e. of vehicles equipped with GPS receiver together with the complete trajectory of each floating car. The method involves the following sequence of operations, schematized in the flowchart of FIG. 8:

Step 805—after the start, the system receives (at the input 135-3) information derived from the PLMN;

Step 810—system also receives (at the input 135-2) information derived from the floating cars;

Step 815—the processing engine 220 identifies the roads or the segments of road in which the floating cars passed in the considered time interval Δt;

Step 820—the processing engine 220 calculates the average speed on the road i in the time interval Δt as the average of the speeds of the floating cars in the same time interval; this speed is differentiated based on the sense of march of the floating cars;

Step 825—the processing engine 220 divides the macroareas into a certain number of sub-areas. For simplicity, the subdivision criterion may be that schematically depicted in FIG. 9: four macroareas 905, 910, 915 and 920 are considered; one of the sub-area elements is identified with reference numeral 925 and is the union of two area elements, the first of which includes the set of points of the macroarea 905 that are close to the macroarea 915, while the second area element is the set of points of the macroarea 915 that are close to the macroarea 905.

Step 830—the processing engine 220 identifies the roads or sections of roads, in respect of which no information from the floating cars are available, and that are geographically contained in a given sub-area (for instance the sub-area 925);

Step 835—the processing engine 220 calculates, for every mobile terminal that has moved from the macroarea 905 to the macroarea 915, the moving speed vAC as the ratio of the distance between the two macroareas (that is, between two reference points, like the geographic center of mass thereof) and the time taken to move (derived by the time instants included in the list received from the PLMN). In a similar way, the processing engine 220 calculates the moving speed vCA for the movement from the macroarea 915 to the macroarea 905, and the moving speeds for the movement of the mobile terminals between the other macroareas;

Step 840—the processing engine 220 determines the average moving speed vmAC from the macroarea 905 to the macroarea 915 averaging the speeds calculated as in the previous step; in the same way, the average moving speed vmCA from the macroarea 915 to the macroarea 905 (opposite march direction) is calculated;

Step 845—the processing engine 220 assigns the average speed value vmAC to all the roads or sections of roads that belong to the sub-area 925 in the march direction from the macroarea 905 to the macroarea 915; the average moving speed vmCA is similarly assigned to the roads or sections of roads for the march direction from the macroarea 915 to the macroarea 905;

Step 850—the system provides in output the calculated speeds on the roads, and the method jumps back to the beginning (step 805) for considering the next time interval Δt.

Seventh Information Processing Method (Method b2)

This method uses as input data the list of mobile terminals and the identifier of the network cells in which each mobile terminal in the list was during a call, when dispatching a message (SMS or SMS), etc., or at the time of a handover, and the list of floating cars with the complete trajectory thereof. The method steps are essentially the same as those of the sixth (method b1), with the difference that the PLMN cells are considered instead of the macroareas, and the center of mass of the PLMN cells is used for calculating the mobile terminal moving speeds.

Eighth Information Processing Method (Method b3)

This method exploits as input data the list of mobile terminals and the geographical position (coordinates x, y) of each mobile terminal in the list at the time where a call was placed or a handover occurred, and the list of floating cars, with the complete trajectory thereof. The method steps are essentially those of the method b1 described above, the area of interest being subdivided into area elements, for example of square shape, of predetermined size, and considering the exact position of the vehicles for the calculation of the moving speeds from an area element to another; in other words, compared to the method b2 described above, area elements are considered instead of cell; the knowledge of the geographic position of the mobile terminals allows assigning every mobile terminal to a certain area element.

Ninth Information Processing Method (Method b4)

Figure 10:
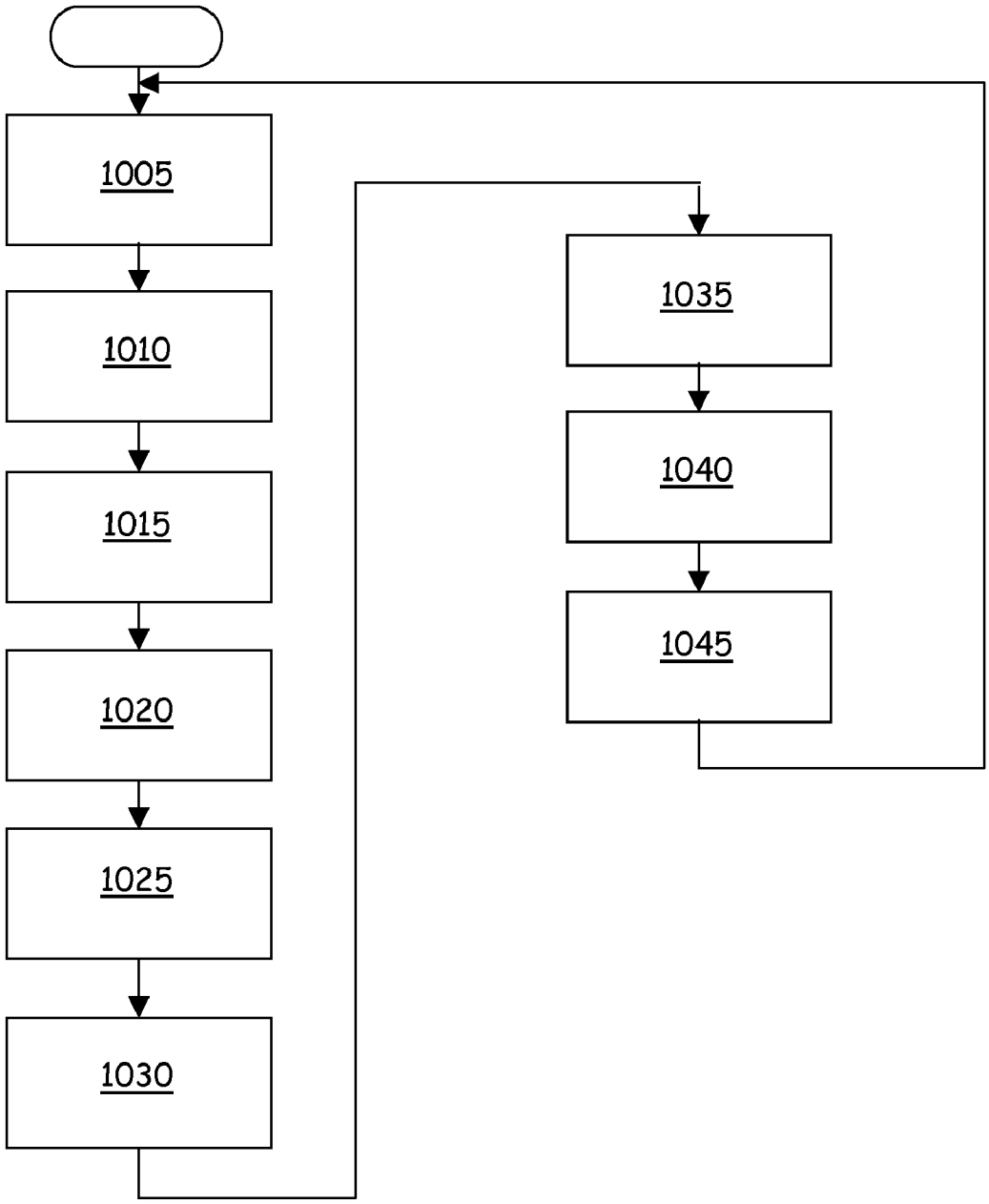
FIG. 10 schematically shows the main steps of another possible information processing method, according to an embodiment of the present invention.

This method uses as input data the list of mobile terminals and the complete trajectory thereof during a call, and the list of floating cars, with the complete trajectory thereof. The method involves the following sequence of operations, schematized in the flowchart of FIG. 10:

Step 1005—after the start, the system receives (at the input 135-3) information derived from the PLMN;

Step 1010—the system also receives (at the input 135-2) information derived from the floating cars;

Step 1015—the processing engine 220 identifies the roads or sections of roads in which the floating cars passed in the considered time interval Δt;

Step 1020—the processing engine 220 calculates the average speed on the i-th road belonging to the roads or sections of roads identified in the preceding step 1015, in the time interval Δt, as the average of the speeds of the floating cars in that time interval; the calculated average speed is differentiated based on the march sense of the floating cars;

Step 1025—among the roads on which no floating car has passed, the processing engine 220 identifies those on which a mobile terminal of which the complete trajectory is available has transited.

Step 1030—the processing engine 220 calculates the average speed on the road j belonging to those roads identified at the preceding step in the interval Δt as the average of the speeds of the mobile terminals in that time interval; also in this case, the calculated average speed is differentiated based on the march sense of the terminals;

Step 1035—the processing engine 220 identifies the remaining roads, on which no floating cars nor mobile terminals passed;

Step 1040—the processing engine 220 calculates the average speed on the road k belonging to the set of roads identified in the preceding step in the time interval Δt, using for example the speeds calculated for the roads in the steps 1015 and 1020, averaging the speed of the two closer roads or assigning to the road k the speed calculated for the road that crosses it, if any (other ways for calculating the speeds are possible);

Step 1045—the system provides in output the speeds on the roads and the method jumps back to the beginning (step 1005) for the next time interval Δt.

From the speeds calculate with any of the four methods described above, the processing engine 220 can derive other information of interest, such as:

- an indication of traffic jam in a road, when the speed on it falls below a predetermined threshold for a certain time interval;
- the trip time on a road, calculated as the ratio of its length, derived from the coordinates stored in the database 215, and the average speed on it;
- the trip time of a certain route, calculated as the sum of the trip times of the roads that compose the route;
- identification of the minimum trip time of a route among all those that connect a starting point and a destination point, selected by the user of the system.

If origin-destination matrixes of roads starting and destination points are available, the processing engine can derive the flows on the roads, or on the road segments, by means of conventional transport engineering techniques.

The system according to the herein described embodiment of the invention can be implemented by means of any data processing system and with any operating system (Windows, Linux, Unix, MAC OS). The computer programs for implementing the system of the present invention can be written in any programming language, such as the Ansi C++, which exhibits good programming flexibility and guarantees high performance levels in terms of processing speed; other programming languages can however be exploited, like Java, Delphi, Visual Basic. The choice of the language Ansi C++ is dictated by the.

The system can be used with any technique of geographical location. In particular, it can be used with the known location techniques like UL-TOA, E-OTD, CGI+TA, E-CGI+TA, etc.

The method and system according to the present invention can be used with any system for the counting of the vehicles. Rubber pipes, metal coils, television cameras, etc. can indifferently be used.

The method and system according to the present invention can indifferently be used with any satellite localization system, particularly GPS, Galileo, EGNOS, GLONASS, COMPASS, etc.

The method and system according to the present invention can receive information from one or more PLMN at a same time, managed by the same telephony operator or not, based on similar or different core network technology, using similar or different network apparatuses.

The present invention has been here described presenting some possible embodiments thereof. Those skilled in the art will readily appreciate that several modifications to the described embodiments are possible, as well as other possible embodiments, which do not depart from the scope of the protection as defined in the appended claims.

The invention claimed is:

1. A method of estimating road traffic on a roads network, comprising:

- receiving information from a first information source and a second information source, wherein the information received from the first information source and the second information source is one among a first information type and a second information type;
- temporarily storing the information received from the first information source and the second information source in a database;
- defining at least two different information processing methods, each one associated with a respective one of said information types, wherein at least one of the different information processing methods is associated with a combination of the first and second information types received from the first and second information sources;
- storing an identifier of the at least one of the different information processing methods associated with the combination of the first and second information types;
- selecting an information processing method of the at least two different information processing methods based on the information type of the received information and on at least one predefined criterion;
- processing the received information with the selected information processing method; and
- providing an estimation of the road traffic based on the result of said processing.

2. The method of claim 1, wherein said first information source includes at least one cellular Public Land Mobile Network (PLMN).

3. The method of claim 2, wherein the information received from the first information source comprises one or more among:

- a list of mobile terminals attached to the cellular PLMN, and identifiers of the macroareas where each mobile terminal in the list is situated;
- a list of mobile terminals attached to the cellular PLMN, and identifiers of the PLMN cells in which each mobile terminal in the list is situated while making a phone call, or while dispatching a message, or when a handover is performed;
- a list of mobile terminals attached to the cellular PLMN, and indications about the geographical positions within the respective PLMN cells of each mobile terminal in the list, at the time a phone call or a handover are performed; and a list of mobile terminals attached to the cellular PLMN, and an indication of a trajectory of each mobile terminal in the list during a phone call.

4. The method of claim 1, wherein said second information source includes at least one among a manual or automatic vehicles counting system, and a system based on information received from a satellite localization system receiver on-board of at least a subset of circulating vehicles.

5. The method of claim 4, wherein said information received from the second information source comprises one or more among:

a list of geographic coordinates of road sections in which manual or automatic vehicles counters are installed, and the number of vehicles counted by each counter in the list, and a list of vehicles equipped with satellite localization system receivers and indications about a trajectory thereof.

6. The method of claim 1, comprising:

arranging the information received from the first information source and the information received from the second information source in a matrix form.

7. The method of claim 6, wherein the different information types received from the first information source are arranged in a matrix column of the matrix form, and the different information types received from the second information source are arranged in a matrix row of the matrix form.

8. The method of claim 7, wherein the information is arranged in said matrix column or row in order of increasing or decreasing complexity of processing the information.

9. The method of claim 8, wherein the information is based on at least information from a cellular Public Land Mobile Network (PLMN) and information from a manual or automatic vehicles counting system, and wherein the processing of the information from the cellular PLMN is more complex than the processing of the information from the manual or automatic vehicles counting system.

10. The method of claim 6, wherein the identifier of the at least one of the different information processing methods associated with the combination of the first and second information types is stored at an intersection of a matrix row and a matrix column.

11. The method of claim 1, wherein said at least one predefined criterion includes at least one of a degree of accuracy of the estimation of the road traffic, an information processing time, the nature of the intended recipient of the estimation of the road traffic, a price paid by the intended recipient of the estimation of the road traffic, and an arbitrary choice.

12. A system for the estimation of road traffic on a roads network, adapted in use to:

receiving information from a first information source and a second information source, wherein the information received from the first information source and the second information source is one among a first information type and a second information type;

temporarily storing the information received from the first information source and the second information source in a database;

defining at least two different information processing methods, each one associated with a respective one of said information types, wherein at least one of the different information processing methods is associated with a combination of the first and second information types received from the first and second information sources;

storing an identifier of the at least one of the different information processing methods associated with the combination of the first and second information types;

selecting an information processing method of the at least two different information processing methods based on the type of information of the received information and on at least one predefined criterion;

processing the received information with the selected information processing method; and providing an estimation of the road traffic based on the result of said processing.

13. The system of claim 12, wherein said first information source includes at least one cellular Public Land Mobile Network (PLMN).

14. The system of claim 13, wherein the information received from the first information source comprises one or more among:

a list of mobile terminals attached to the cellular PLMN, and identifiers of macroareas where each mobile terminal in the list is situated;

a list of mobile terminals attached to the cellular PLMN, and identifiers of the PLMN cells in which each mobile terminal in the list is situated while making a phone call, or while dispatching a message, or when a handover is performed;

a list of mobile terminals attached to the cellular PLMN, and indications about geographical positions within the respective PLMN cells of each mobile terminal in the list, at the time a phone call or a handover are performed; and a list of mobile terminals attached to the cellular PLMN, and an indication of a trajectory of each mobile terminal in the list during a phone call.

15. The system of claim 12, wherein said second information source includes at least one among a manual or automatic vehicles counting system, and a system based on information received from a satellite localization system receiver on-board of at least a subset of circulating vehicles.

16. The system of claim 15, wherein said information received from the second information source comprises one or more among:

a list of geographic coordinates of road sections in which manual or automatic vehicles counters are installed, and the number of vehicles counted by each counter in the list, and a list of vehicles equipped with satellite localization system receivers and indications about a trajectory thereof.

17. The system of claim 12, wherein the information received from the first information source and the information received from the second information source are arranged in a matrix form.

18. The system of claim 17, wherein the different information types received from the first information source are arranged in a matrix column of the matrix form, and the different information types received from the second information source are arranged in a matrix row of the matrix form.

19. The system of claim 18, wherein the information is arranged in said matrix column or row in order of increasing or decreasing complexity of processing the information.

20. The system of claim 19, wherein the information is based on at least information from a cellular Public Land Mobile Network (PLMN) and information from a manual or automatic vehicles counting system, and wherein the processing of the information from the cellular PLMN is more complex than the processing of the information from the manual or automatic vehicles counting system.

21. The system of claim 17, wherein the identifier of the at least one of the different information processing methods associated with the combination of the first and second information types is stored at an intersection of a matrix row and a matrix column.

22. The system of claim 12, wherein said at least one predefined criterion includes at least one of a degree of accuracy of the estimation of the road traffic, an information processing time, the nature of the intended recipient of the estimation of the road traffic, a price paid by the intended recipient of the estimation of the road traffic, and an arbitrary choice.

* * * * *

UNITED STATES PATENT AND TRADEMARK OFFICE

CERTIFICATE OF CORRECTION

PATENT NO. : 8,340,718 B2
APPLICATION NO. : 12/809008
DATED : December 25, 2012
INVENTOR(S) : Massimo Colonna et al.

It is certified that error appears in the above-identified patent and that said Letters Patent is hereby corrected as shown below:

In the Claims

Column 20, Claim 3, Line 59:
Please delete “of the macroareas” and insert --of macroareas--

Column 20, Claim 3, Line 67:
Please delete “about the geographical” and insert --about geographical--

Signed and Sealed this
Third Day of December, 2013

Margaret A. Focarino

Margaret A. Focarino
*Commissioner for Patents of the United States Patent and Trademark Office*